United States Patent [19]

Ilott

[11] Patent Number: 4,941,614

[45] Date of Patent: Jul. 17, 1990

[54] NOZZLE FOR SPRAYING EQUIPMENT

[76] Inventor: Jan Ilott, 14 Montague Hill, Kingsdown, Bristol, United Kingdom

[21] Appl. No.: 215,194

[22] Filed: Jul. 1, 1988

Related U.S. Application Data

[63] Continuation-in-part of Ser. No. 948,357, Nov. 26, 1986, abandoned.

[51] Int. Cl.[5] ..... B05B 1/28

[52] U.S. Cl. ..... 239/294; 239/299; 239/346; 239/459; 239/583; 239/602

[58] Field of Search ..... 239/107, 117, 118, 290, 239/294, 296, 297, 298, 299, 346, 456, 459, 460, 583, 584, 600, 602

[56] References Cited

U.S. PATENT DOCUMENTS

| | | | |
|---|---|---|---|
| 2,619,116 | 11/1952 | Ralston | 239/583 |
| 3,027,096 | 3/1962 | Giordano | 239/602 |
| 3,111,271 | 11/1963 | Lofgren | 239/583 |
| 3,224,677 | 12/1965 | Schmidt et al. | 239/585 |
| 3,250,474 | 5/1966 | McKernan | 239/117 |
| 3,545,682 | 12/1970 | Beard | 239/602 |
| 3,685,736 | 8/1972 | Diegelman | 239/296 |
| 3,711,020 | 1/1973 | Zelna | 239/602 |
| 4,161,289 | 7/1979 | Rebold | 239/346 |
| 4,171,097 | 10/1979 | Rebold | 239/346 |
| 4,537,357 | 8/1985 | Culbertson et al. | 239/290 |
| 4,562,965 | 1/1986 | Ihmels et al. | 239/346 |

FOREIGN PATENT DOCUMENTS

| | | |
|---|---|---|
| 99097 | 5/1923 | Fed. Rep. of Germany . |
| 2119288 | 11/1983 | United Kingdom . |

*Primary Examiner*—Andres Kashnikow
*Assistant Examiner*—Michael J. Forman
*Attorney, Agent, or Firm*—Hale and Dorr

[57] ABSTRACT

A nozzle, for use in a gas-operated spraying apparatus such as an airbrush, is disclosed. The nozzle locates concentrically within an air cap in the gas outlet of a spraying apparatus and cooperates with a tapered needle located in an axial passage thereof to seal the outlet of the nozzle. The needle is retractable in the nozzle to dispense a medium such as paint to be sprayed.

14 Claims, 7 Drawing Sheets

FIG. 1
PRIOR ART
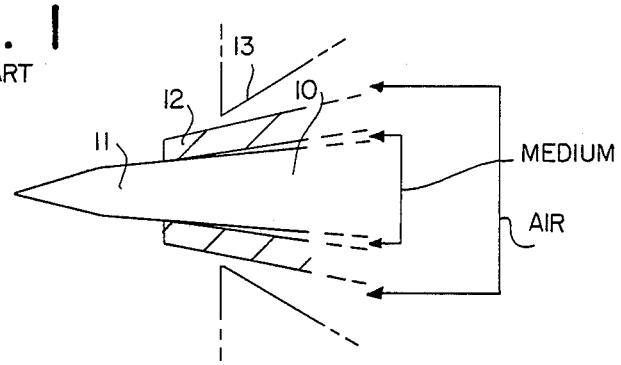
FIG. 2
PRIOR ART
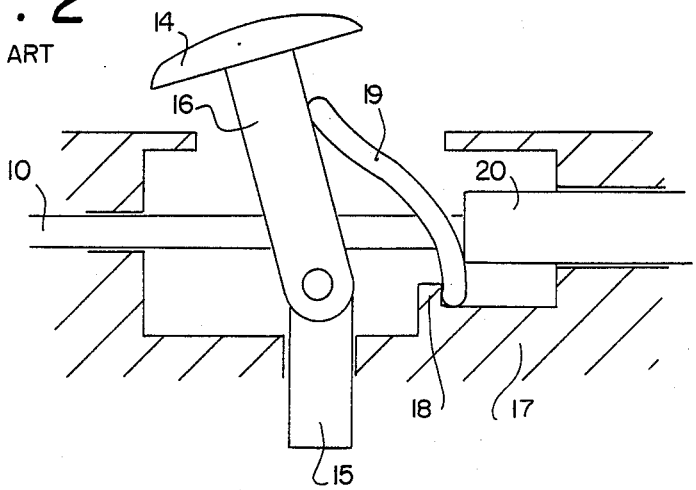
FIG. 3
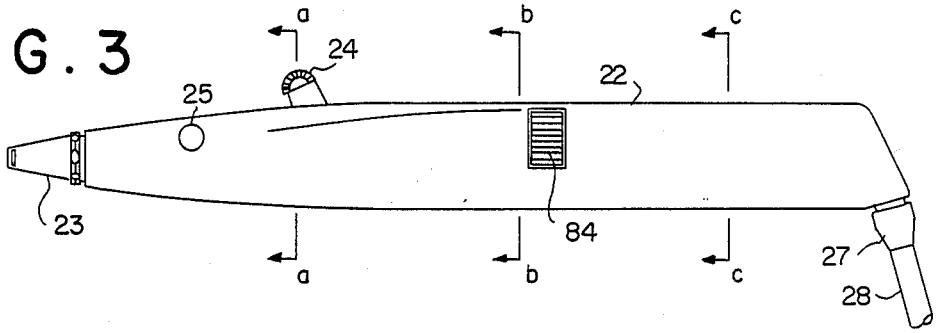
FIG. 3b
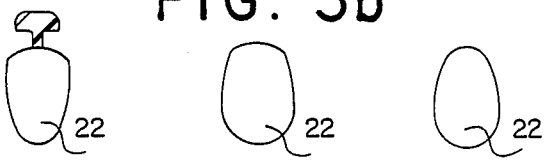
FIG. 3a FIG. 3c FIG. 6
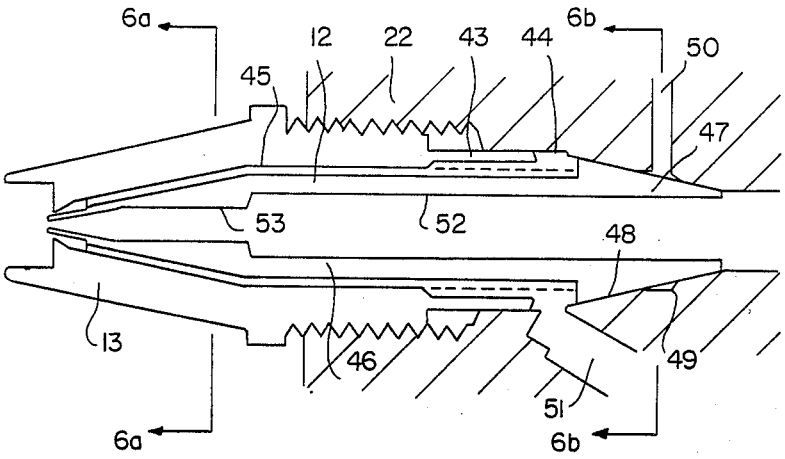
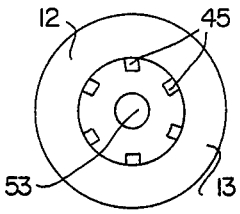
FIG. 6a
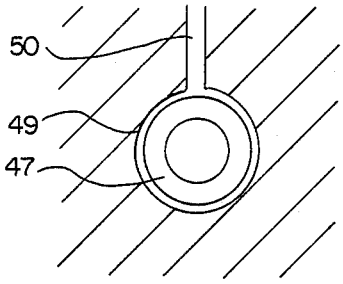
FIG. 6b
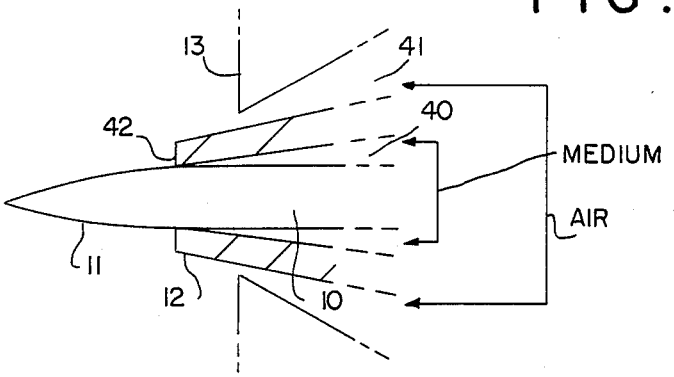
FIG. 5

FIG. 10
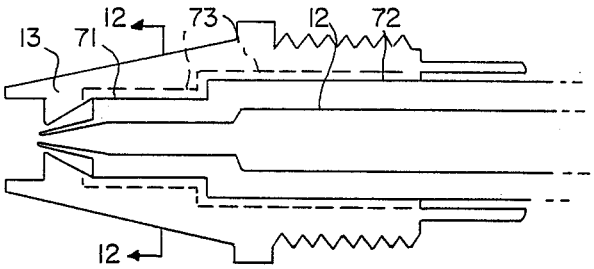
FIG. 12
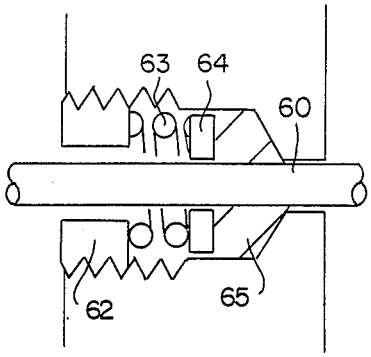
FIG. 11
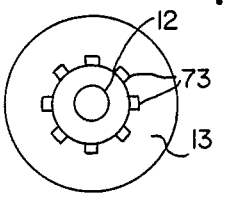
FIG. 16
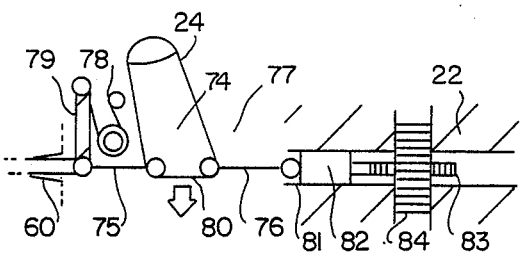
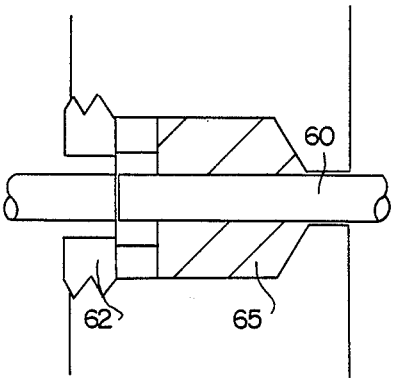
FIG. 12a

NOZZLE FOR SPRAYING EQUIPMENT

CROSS-REFERENCE

This application is a continuation-in-part of patent application Ser. No. 948,357 filed November 26, 1986 now abandoned, which application is incorporated herein by reference.

FIELD OF THE INVENTION

This invention relates to gas-operated spraying equipment and particularly, but not exclusively, to airbrushes. Airbrushes are tools used by artists and illustrators for selectively spraying coloured dyes or pigments dissolved or dispersed in an aqueous or other liquid solvent or carrier to form inks, paints or similar media (hereinafter referred to as "paint" for the sake of convenience), and are used extensively in the preparation of advertisements and like commercial artwork, although such is the skill of exponents that airbrush work is now considered a fine art form.

BACKGROUND OF THE INVENTION

A definitive work detailing the history, the construction and use of airbrushes is "The Airbrush Book" by Seng-gye Tombs Curtis and Christopher Hunt published by Orbis Publishing Limited, London in 1980. This reference describes in detail the various types of airbrush past and present. As fine art tools, airbrushes are relatively delicate and, moreover, they are expensive. For example, conventionally, the nozzle and/or the needle (which control the release of paint) may be made of brass, stainless steel or a platinum alloy. They are easily damaged in that, to provide a different sized nozzle, to replace a damaged nozzle or needle, or for cleaning purposes, the airbrush must be disassembled, cleaned and reassembled. During reassembly, the needle must be inserted into the nozzle to exactly the correct extent to ensure a seal and to avoid damaging the nozzle.

FIG. 1 is a diagrammatic fragmentary cross-section of a known nozzle/needle combination.

The needle 10 has a tip of substantially conical shape sealingly fitting into a nozzle 12 projecting through the nozzle outlet so that, even when retracted during spraying, the end of the needle still projects beyond the nozzle outlet, the surface of the needle tip conveying paint to the exterior of the nozzle. The aperture in the nozzle 12 may be, for example, 0.2 mm. The diameter of the needle may taper from 1.5 mm to a point. Such a nozzle/needle combination can be seen in, for example, Swiss patent specification No. 99097 or U.S. Pat. No. 4,161,289. This combination provides better and more even delivery of paint than arrangements wherein, upon retraction, the needle lies wholly within the nozzle as shown, for example in U.S. Pat. No. 3,224,677 or U.K. specification No. 2,119,288.

As can be seen from the aforementioned Swiss patent specification No. 99097, the angle of taper is small so that, upon retraction of the needle, a considerable movement is necessary to give an appreciable change in the size of the annulus between the needle and the nozzle to vary the flow of paint. This is desirable so as to give greater control of paint flow. However, if the angle of taper of the needle is too small, the mechanical advantage is such that on moving to the closed position, the needle tip 11 tends, in use, permanently to spread the nozzle opening. The sealing may be reduced but also the airbrush no longer has the required control characteristics in the dispensation of paint. If the needle is bent, the paint will not flow evently. If the nozzle is bent or distorted, it will not locate concentrically with the needle or a surrounding air cap 13 and the airflow through the respective annuli between the needle and the nozzle and between the nozzle and the air cap will be uneven. Uneven flow of paint or of air gives rise variously to spatter, spitting, lack of focus or asymmetrical spray pattern. In an extreme case, of course, the nozzle 12 may well be split or cracked by the needle tip 11.

The needle and the nozzle are both relatively expensive items to replace but the errors produced due to the above-mentioned faults and to the time lost in correcting faulty artwork and/or in replacement or cleaning, can be more expensive.

Other forms of spraying equipment utilise concentric needle, nozzle and air cap arrangements and, to varying extents, suffer from the disadvantages above ascribed to airbrushes. The present invention relates equally to such other forms of spraying equipment.

An object of the present invention is the provision of an improved nozzle arrangement of low cost wherein the aforesaid disadvantages are minimised or overcome.

SUMMARY OF THE INVENTION

According to one aspect of the present invention, there is provided a nozzle, for a gas-operated spraying apparatus, having a passage for paint to be dispensed, the passage having an outlet of reduced size at its forward end arranged, in use, to cooperate with a tapered needle located in the passage and extending through the outlet to form a seal, characterised in that the nozzle is made of a resiliently extensible material arranged to be stretched slightly by the needle on movement beyond a seal-forming location but having sufficient resilient memory to return to its original shape, as the needle is retracted.

According to a preferred embodiment of the present invention, there is provided a nozzle for a gas-operated spraying apparatus, the nozzle being tapered at an outlet end and having a passage therethrough wherethrough, in use, a medium to be sprayed may flow to the outlet under the control of a retractable needle of circular cross-section extending substantially coaxially of the passage and of the nozzle, the outlet forming a seal with the needle in a rest position thereof, and in which the outlet is of non-circular form, the nozzle being formed of a material deformable by the needle to form the seal.

The invention also provides a nozzle, preferably but not necessarily as aforesaid, in unit form with a contained needle, the needle being of substantially the same length as the nozzle.

The outlet end of the nozzle is preferably of conical shape coaxial with the passage through the nozzle.

The outlet end may have a plurality of tapered regions.

Preferably, the outlet is planar and is constituted by a truncation of the tapered end in a plane not orthogonal to the passage.

The nozzle is intended to cooperate with an air cap of a spraying apparatus. In a preferred embodiment, the nozzle has cooperating means on a body thereof permitting the nozzle to be indexed, in use, relative to the air cap.

A nozzle made of such a material, for example, a plastics material resistant also to the paint to be applied by the airbrush, permits the use of a needle with a lesser taper thereby giving even greater control of the flow of paint.

A nozzle made of an appropriate plastics material may be injection moulded at low cost and yet with high precision. The resilience of the material allows greater tolerances on the needle whilst still providing an excellent seal therewith and very fine control in use.

The nozzle is arranged, in use, for insertion axially in the gas outlet of a spraying apparatus. Preferably, the nozzle has its own integral seals for sealing, in use, between paint and gas passages in the spraying apparatus.

The nozzle may have grooves in the external surface thereof for cooperating, in use, with internal surfaces of the spraying apparatus to define gas passages.

Advantageously, the nozzle's integral seals include means cooperating, in use, with the internal surfaces of the spraying apparatus, for obviating the pressure difference between the gas passages and paint passages for preventing gas leaking into the paint.

It is preferred that at least a part of the external surface of the nozzle is of non-circular shape and is arranged, in use, to mate with a correspondingly shaped part of the internal surfaces of a spraying apparatus to prevent rotation of the nozzle on insertion thereof into such spraying apparatus.

The nozzle's passage, at its forward end, may taper internally to the reduced outlet, the taper being in the range from 5 to 8 degrees. Alternatively, the passage, in this region, may be stepped or be tapered and stepped to give a final taper which may be as low as 0 degrees. Preferably, the passage extends axially of the full length of the nozzle, the needle being arranged co-axially therein.

In use, the nozzle is mounted in a gas-operated spraying apparatus preferably having a retractable plunger which cooperates with the needle, the plunger being spring-loaded towards a rest position in which the needle is urged thereby into sealing engagement with the nozzle. For the finest work, it is essential that maximum control is exercised over the initial movement of the needle.

"Double-independant-control" of air and paint is provided by a single operating member in most high class commercially available airbrushes. The operating member is depressed to increase the flow of air and is moved in a second substantially perpendicular direction, usually rearwardly, to control the retraction of the needle and thereby the flow of paint.

FIG. 2 of the accompanying drawings is a fragmentary diagrammatic sketch of a prior art airbrush air and paint/needle control means similar to that shown in the aforesaid U.S. Pat. No. 4,161,289.

A manually operated member constituting a control means comprises a button 14 depressable to move a rod 15 pivotally connected thereto whereby progressively to open an air valve (not shown). The rod slides in an aperture of the body member 17. The button stem 16 is bifurcated to straddle the needle 10. The body member 17 provides a fulcrum 18 whereabout a lever 19 may pivot. The lever 19 engages a needle support 20 and thereafter is curved forwardly to form a sliding engagement with the stem 16. Pivotal movement of the stem 16 in a clockwise direction (as seen in the drawings) pivots the lever 19 about its fulcrum and urges the needle support 20 and hence the needle 10 to the right. The needle is thereby retracted in the nozzle (not shown) to dispense the paint. The arrangement constitutes an approximately 1:4 linkage and the movement of the needle 10 corresponds substantially linearly to that of the button 14. Such movement does not give rise to the desired initial finest control mentioned above.

Described hereinafter is a novel control means (forming the subject of my co-pending U.S. application Ser. No. 948,356 filed November 26th 1986 and claiming priority also from U.K. patent application No. 8507966 filed March 27th 1985) enabling finer initial control of the movement of the needle.

BRIEF DESCRIPTION OF THE DRAWINGS

The invention will be described further, by way of example, with reference to FIGS. 3 to 18 of the accompanying drawings, in which:

FIGS. 1 and a 2 show prior art arrangements, as above described;

FIG. 3 is side elevation of a preferred form of airbrush incorporating a nozzle having the features of this invention;

FIGS. 3*a*, 3*b* and 3*c* indicate the detached transverse sectional shape of the airbrush on the lines a—a, b—b and c—c respectively;

FIG. 5 is a fragmentary section of the tip of a needle and a nozzle according to the present invention;

FIG. 6 is a vertical cross-sectional view of the nozzle end of an airbrush, showing one preferred nozzle;

FIGS. 6*a* and 6*b* are detached cross-sections taken on the lines 6*a*—6*a* and 6*b*—6*b* of FIG. 6;

FIG. 10 illustrates diagrammatically a modified form of nozzle and air cap of an airbrush;

FIG. 11 is a detached cross-section taken on the line 11—11 of FIG. 10;

FIG. 12 illustrates an alternative manner of sealing a needle operating plunger in the body of an airbrush;

FIG. 12*a* illustrates, diagrammatically, a diaphragm seal between a needle and its plunger;

FIG. 16 is a diagrammatic sketch of an operating member and its associated mechanism.

DESCRIPTION OF PREFERRED EMBODIMENTS

Figure 4:
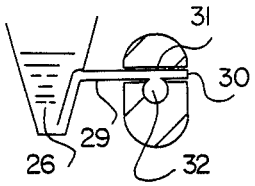
FIG. 4 is a diagrammatic cross-sectional view of one form of side-mounted paint cup and its manner of connection to the airbrush of FIG. 3.

As shown in FIG. 3 of the drawings, an airbrush incorporating the nozzle of the present invention, may itself be of novel shape. The airbrush comprises a body 22 preferably moulded from a plastics material of light-weight but high strength. The body 22 is symmetrical about its vertical longitudinal midplane as indicated by the cross-section sketches in FIGS. 3*a*, 3*b* and 3*c*. The body 22 has an air cap 23 which locates the nozzle and needle assembly (described below) in the body, an operating member 24 for controlling the feed of air and paint to the nozzle, a transverse through hole 25 for receiving a paint cup 26 (FIG. 4) or a blanking plug or plugs when a pressurised paint feed is used, and an air or an air and paint connector 27 whereby air or air and paint to be sprayed may be fed to the airbrush, via a connecting pipe or pipes 28. The sockets for connector 27 and the pipes 28 thereto may be coaxial or side by side.

Figure 4A:
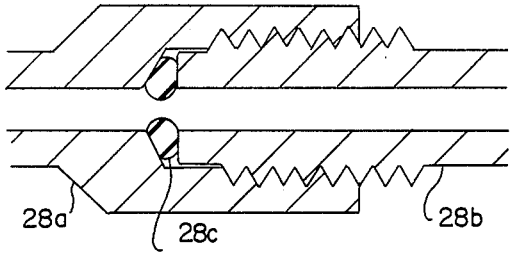
FIG. 4*a* is a diagrammatic view of an air limiting valve usable in an airbrush according to the present invention.

As shown in FIG. 4*a*, the coupling between the airline and the airbrush comprises two axially-bored screw-threaded relatively rotatable members sandwiching therebetween a soft resilient O-ring. Screwing of the male member into the female member causes the O-ring to be deformed obturating the axial passage. In this way, a throttle valve is incorporated into the airline permitting the maximum airflow to be preset. However, it is envisaged that at least the airline connecting pipe 28 will be couplable to the airbrush by some quick-release coupling, for example, a bayonet coupling. The arrangement shown in FIG. 4*a* could be provided in one half of such a coupling.

If the paint to be applied by the airbrush is supplied in the side-mounted cup 26(as shown in FIG. 4), the cup preferably has a radially extending feed pipe 29, closed at its end 30 and shaped so as to draw paint from the bottom of the cup 26. The pipe 29 has an aperture 31 adjacent the closed end 30 arranged to communicate, when inserted from either end, as desired, into the through hole 25, with a longitudinal paint feed passage 32 in the body 22.

In the paint to be sprayed is to be fed by pressure to the airbrush, it is advantageous that the pressure of the paint at the airbrush is maintained constant.

Referring now to FIGS. 5 to 12 of the drawings, novel features of the needle 10, nozzle 12 of the present invention, and air cap 13 will be described. The nozzle 12 is a one piece injection moulding of a plastics material resistant to the paint it is likely to encounter, may have a high dimensional stability, good fatigue resistance and a high elongation before break. A preferred material for the nozzle is an acetal resin such as the coor homo-polymer of polyoxymethylene. Upon elongation of either of these materials, the yield point occurs above 7% elongation. Other suitable materials have yield points between 5% and 10% elongation. In its cooperation with the needle, the nozzle is intentionally stressed. It is preferred that the yield point is not exceeded in order fully to utilise the memory of the plastics material. However, it is known that some plastics materials retain most of their memory even when stressed beyond the yield point and can recover their shape upon simple warming. Certain plastics materials may perform better if they are plastically pre-strained i.e. if they are stretched beyond their yield points. This may be effected by forcing the needle into the nozzle outlet.

Depending on the use to which the airbrush is to be put, the needle 10 may be of a plastics material or of a metal such as stainless steel or tungsten or may be coated or plated with tungsten, platinum or gold or may be treated, for example, by nitriding to provide appropriate surface characteristics. The nozzle 12 presents, at its forward end, an outlet in a frustro-conically shaped portion 15, the outlet being, with the needle in its rest position, sealed to prevent the escape of paint from a substantially annular paint flow passage 40. For an airbrush, the nozzle outlet and the needle tip are microscopic in size and hence for the purposes of illustration have been enlarged and somewhat exaggerated. The needle 10 has a tip 11 of varying taper, the taper being greatest adjacent the point and lessening (to be in the range of 1 to 6 degrees) towards the region whereat it forms a seal with the nozzle. In this region, the diameter of the needle tip 11 is only slightly greater than the diameter e.g. 0.2 mm, of the outlet in the nozzle whereby the latter is stretched by engagement with the needle as the needle moves slightly beyond its initial seal-forming position.

As the needle is withdrawn (moved to the right in the drawings) due to its shallow taper and due to the contraction of the plastics material of the nozzle (caused by its memory), excellent control is achieved of the dispensation of paint through the nominally annular passage 40 therebetween because of the greater movement of needle necessary to produce a change in the quantity of paint dispensed.

The nozzle 12 locates, in use, substantially concentrically within an air cap 13 and defines therewith an annular passage 41 for the flow of air. The frustro-conical shape of the portion 15 of the nozzle 12 presents an annular land 42 which creates a negative pressure to draw paint out of the nozzle, and enhances turbulent flow in the air stream. A fillet of paint forms a reservoir in the angle between the needle and the land. The air turbulence atomises paint from this reservoir and from the needle and the air flow is drawn over the tip 11 of the needle 10. This land may take different shapes to increase or decrease the atomisation or the suction of paint. For example, the land 42 as shown is substantially at right angles to the axis of the nozzle. It may also take the form of a convex or concave slope of constant or varying radius of curvature or may be constituted by a slope of greater taper than that of the conicity of the remainder of the frustro-conical portion 15. Yet another variation of nozzle tip is described hereinafter in relation to FIGS. 13 to 15.

Within the principle upon which the present invention is based and described generally in relation to FIG. 5, many variations are possible in the cooperation between the needle and the nozzle or between the nozzle and the air cap to achieve particular effects. These are exemplified by the fragmentary diagrammatic sketches forming FIGS. 5*a* to 5*h*.

Figure 5A:
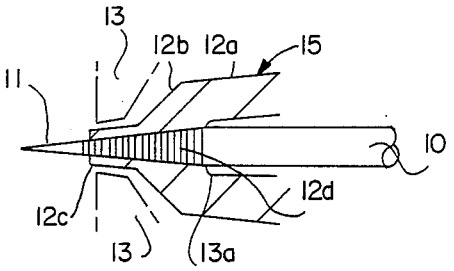
FIGS. 5*a* to 5*h* illustrate modifications of the arrangement shown in FIG. 5.

In FIG. 5*a*, the portion 15 of the nozzle 12 is shown as having three distinct regions of external taper. A first region 12*a* permits internally a relatively large passage for paint terminating in a steep internal shoulder 13*a*. The second region 12*b* is steeper than the first but axially offset from the internal shoulder to strengthen the nozzle in the region of the tip. The third region 12*c* is of taper only slightly greater than the internal taper of the nozzle outlet to provide the nozzle tip with the necessary stretchability. It will be seen that the air cap 13 is correspondingly shaped to provide a passage for air which will create the suction necessary to suck paint. Striations are also shown at 12*d* in this drawing. These represent annular roughening on the surface of the needle and/or the internal surface of the nozzle tip. It will be seen that the projecting tip of the needle is smooth to prevent the build-up of paint thereon. The internal taper of the nozzle outlet and the external taper of the needle tip can be quite high whilst still retaining the feature of stretching the nozzle and consequent contraction thereof upon retraction of the needle as described above.

Figure 5B:
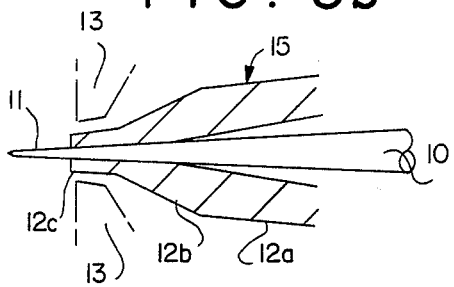

FIG. 5*b* illustrates a nozzle tip 15 similar to that shown in FIG. 5*a*. However, the internal surface of the nozzle and the external taper of the needle are much less. The internal surface of the nozzle tip may be roughened. Axial or helical grooves may be provided in an initial part of this surface which contacts the needle to provide better paint flow whilst maintaining the fine control of dispensation provided in accordance with the present invention. The internal taper of the nozzle and the taper of the needle may alternately or additionally be chosen such that, on retraction of the needle, a wedge-shaped passage for paint is formed. The angle of this wedge is arranged to encompass the particle-size range expected in a pigment-based paint to be sprayed.

Figure 5C:
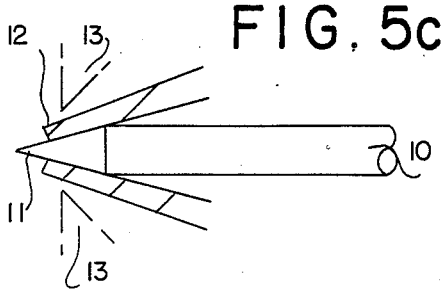
Figure 5D:
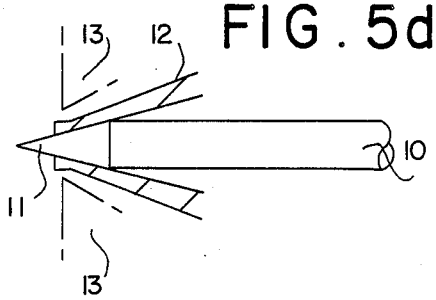
Figure 5E:
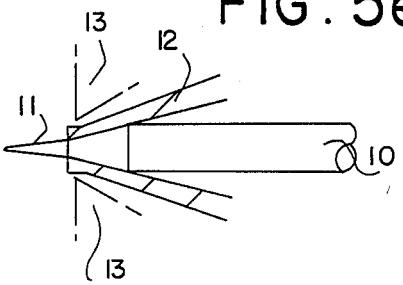

FIGS. 5*c*, 5*d* and 5*e* (and also FIGS. 13 to 15) illustrate different forms that the end of the nozzle tip can take within the scope of the invention. It is essential that the needle tip project beyond the nozzle tip to provide focus of paint sprayed. Excessive projection reduces atomisation efficiency and too little projection reduces focussing thus preventing fine lines from being drawn. Bearing this in mind, it is still possible to increase the angle of taper of the needle for example to 12 degrees as shown (somewhat exaggerated) in the drawings. To achieve appropriate atomisation and focus, it is then preferred to have the end of the nozzle tip sharply undercut (FIG. 5*c*), to provide a terminal land on the nozzle tip (FIGS. 5*d* and 5*e*) or to provide a stepped taper on the needle tip (FIG. 5*e*).

Figure 5F:
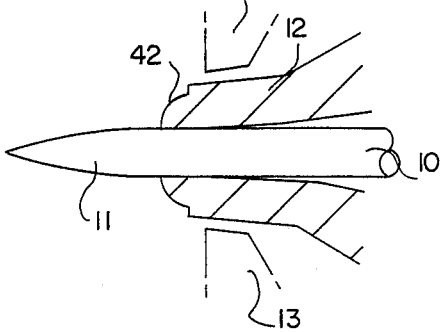

The nozzle/needle combination shown in FIG. 5*f* illustrates another advantageous feature of the present invention. If the land 42 on the nozzle is formed as a smooth convex slope, with or without a step, only a very shallow fillet of paint can locate in the angle. Even at low rates of air flow, the tendency for paint to be stripped from this reservoir in relatively large globules is minimised as there is insufficient depth of paint in the reservoir.

Figure 5G:
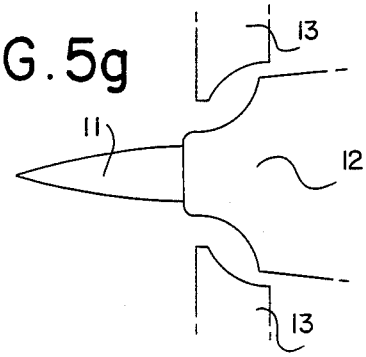
Figure 5H:
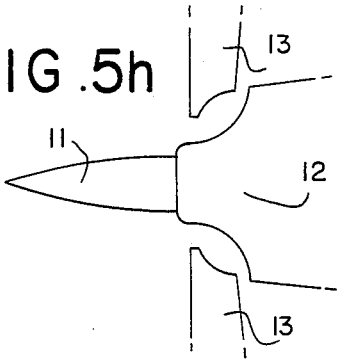

FIGS. 5*g* and 5*h* show cooperation between the nozzle tip and the concentrically located air cap 13 to modify the airflow over the needle tip. It has been found that efficient atomisation of paint can be maintained at low air pressure.

As can be seen in FIG. 6, the air cap 13 serves to locate the nozzle 12 in the body 22 of the airbrush, the air cap being a screw fit into a threaded socket in the front end of the airbrush. The air cap 13 has a skirt 43 which may be flexible arranged to fit sealingly into an appropriately dimensioned bore 44 in the body 22. Internally, the air cap 13 is shaped to receive the frustro-conical shaped portion 15 of the nozzle 12 and defines therewith air passages 45 (FIG. 6*a*) in the surface of the nozzle 12 and/or internally of the cap 13. To achieve greater air flow, the air passages 45 may be of trapezoidal cross-section.

The nozzle 12 has a hollow central cylindrical portion 46 having the frustro-conical shape 15 at its forward end and a tapered hollow plug 47 at its rear end. The plug 47 is a compression fit into a similarly tapered recess 48 in the body 22. An air vent ring 49 is provided in the surface of the plug 47 (FIG. 6*b*) or the recess 48 (FIG. 6) and an air vent 50 leads therefrom to the exterior of the body 22. In another embodiment (not shown), the plug 47 has stepped lands and the recess 48 is similarly shaped, one of the steps providing an annular air vent ring acting in the same way as the ring 49 and communicating with an air vent 50.

Air is supplied via a passage 51 in the body 22 to the space between the central cylindrical portion 46 of the nozzle 12 and the skirt 43 of the air cap 13 and thence, via the air passages 45 to the air outlet defined by the air cap 13 and the conical portion 15 of the nozzle 12.

Figure 7:
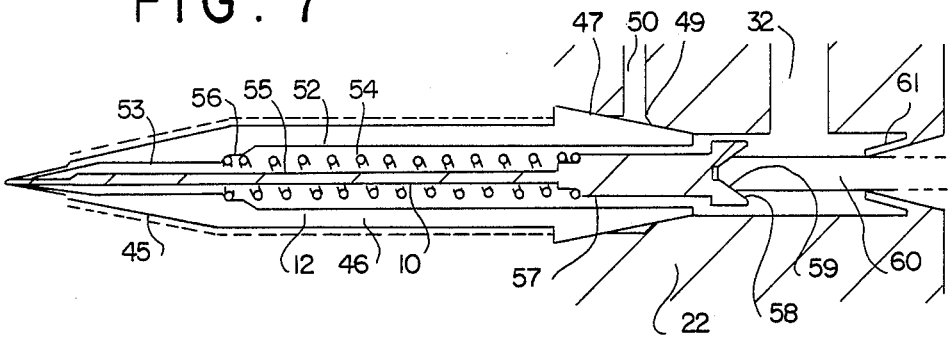
FIG. 7 is a vertical section, corresponding to part of FIG. 6, but showing also a needle and its operating plunger.

The nozzle 12 has a first diameter bore 52 extending from the rear to adjacent the frustro-conical portion and a second lesser diameter bore 53 tapered at its forward end, the taper (in this embodiment) being in the range of 5 to 8 degrees. The needle 10 is located in these bores as shown in FIG. 7. A spring 54 surrounds the needle. The spring 54 or the needle 10 may be coated with a release agent to prevent binding but, preferably, the spring floats clear of the internal surface of the bore 52 and the surface of the needle stem 55. The spring 54 abuts at its forward end against the shoulder defined by the change in diameter between the first and second bores 52 and 53. It is preferred, however, to provide a stepped or tapered shoulder 56 at this point so as to locate and hold the forward end of the spring 54. The other end of the spring engages a head 57 of the needle 10 and is compressed so as to bias the needle to the right (as shown in the drawings). The needle is held in the bores by the spring which may also assist in centering the needle therein.

Figure 9A:
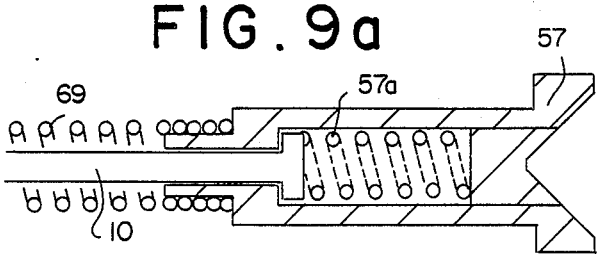
FIG. 9*a* illustrates a modified form of head of a needle which may be used in any of the embodiments of needles described herein.

The head 57 of the needle has a self-centering recess 58 wherein an end 59 of an operating plunger 60 locates. The head 57, besides centering the needle in the bores, serves also to prevent over-insertion of the needle in the bores. The construction of the nozzle from a plastics material, in accordance with the present invention, provides a range of non-destructive sealing positions of the needle in the nozzle outlet. In most embodiments, the needle head, particularly the modified head shown in FIG. 9*a*, ensures that this range is not exceeded even when the needle tip has a relatively steep taper and the plunger cooperates with the needle to define a sealing position of the needle intermediate the extremes of the range. It will be seen from FIG. 6*a* that some relative movement is provided between the needle 10 and the head 57. A spring 57*a* biases the needle 10 to an extended position within the head 57 but, should the needle 10 encounter excessive resistance on movement of the head towards the rest (sealing) position of the needle, the needle can move rearwardly relative to the head. A passage for the flow of paint to be applied extends from the feed passage 32, around the head 57 of the needle and through the first and second diameter bores of the nozzle to the tip 11 of the needle.

The plunger 60 may be sealed in the body by a pressure operated skirt 61 as shown in FIG. 7. Alternatively, as shown in FIG. 12, a stuffing box seal comprising a screw 62, spring 63, washer 64 and packing material 65 such as P.T.F.E. tape may seal the plunger 60 into the body 22 against the ingress of paint. In yet another embodiment (FIG. 12*a*), the plunger may be sealed to the body by a diaphragm whereby to avoid sliding surfaces. In this embodiment, a screw 62 locates a diaphragm 63*a* mounted on a washer 64. The plunger slides in a guide 65*a*. Either the needle 10 may abut directly against the diaphragm 63*a* or alternatively, a projection secured to the diaphragm may contact a needle head such the needle head 57 shown in FIGS. 7 to 9*a*.

Figure 8:
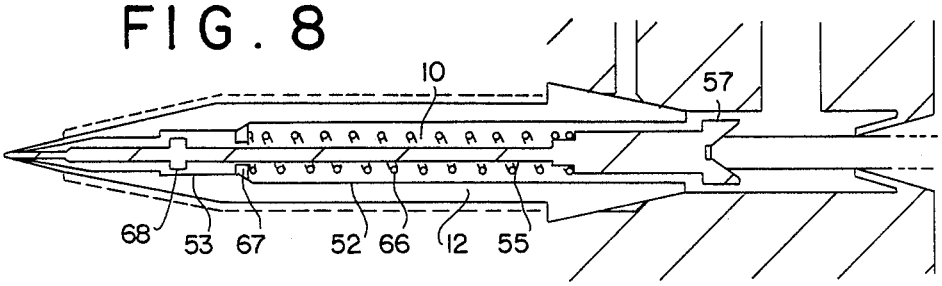
FIGS. 8 and 9 illustrate modified forms of the needle shown in FIG. 7.

As can be seen from FIG. 8, the needle 10 may be provided with a pre-compressed spring 66 held in position on the needle stem 55 by a washer 67 and obturation 68 whereby to ensure a bias on the needle independent of the extent of insertion of the needle 10 into the nozzle 12.

Figure 9:
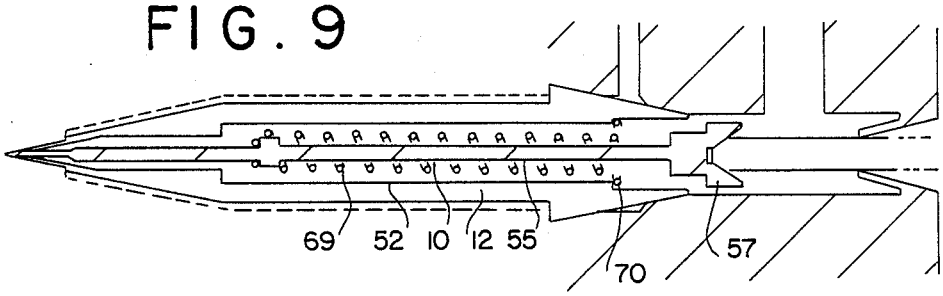

Alternatively, and as shown diagrammatically in FIG. 9, an extension spring 69 secured to the needle stem 55 or having a reduced diameter portion locating on a shoulder thereof and at the other end locating on shoulder 70 of the nozzle 12 may serve to bias the needle towards its retracted position. The extension spring 69 preferably has a high initial tension.

FIG. 10 shows an alternative method of locating the nozzle 12 in the air cap 13. In this embodiment, the nozzle 12 has rearwardly of its frustro-conical portion, a first diameter cylindrical portion 71 and a second diameter cylindrical portion 72. Either or both portion may be interference fits within corresponding bore portions of the air cap 13. Air passages 73 are provided longitudinally and in the surface of the cylindrical portions of the nozzle 12 or of the corresponding bore portions of the air cap 13.

Figure 13:
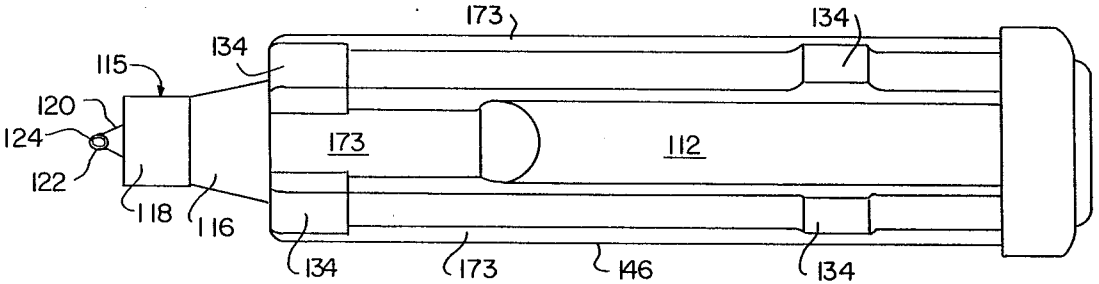
FIG. 13 is a side elevation of a nozzle according to a further embodiment of the present invention.
Figure 14B:
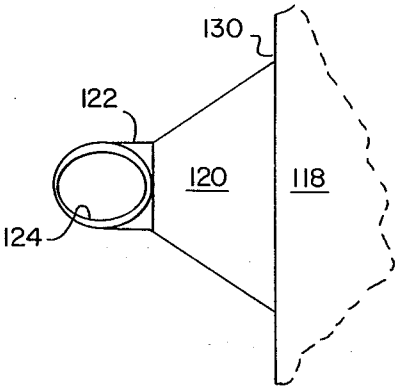
FIGS. 14*a* and 14*b* are fragmentary top and side elevations, to an enlarged scale, of the tip of the nozzle of FIG. 13.
Figure 14A:
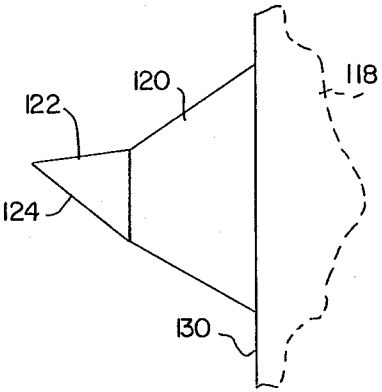

In another embodiment (not shown), the nozzle is a screw fit (preferably, a left hand thread) within the air cap to prevent rotation or other movement of the nozzle relative to the air cap. A seal, similar to the seal 47 shown in FIG. 6, but which permits limited axial movement, is provided in this embodiment. This arrangement permits accurate location of the needle relative to the nozzle and to air cap. The air cap may then be screwed or otherwise located in the airbrush body to determine the end position of the needle. Yet another method of preventing the nozzle from rotating in the air cap is to provide the cylindrical portion 46 or conical portion 15 of the nozzle with a non-circular e.g. polygonal, cross-section or with ribs 134 as shown in FIG. 13. The internal surface of the mating section of the air cap is then correspondingly shaped, air passages 45 being provided, as previously described, in the surface of the nozzle or in the air cap.

Figure 15:
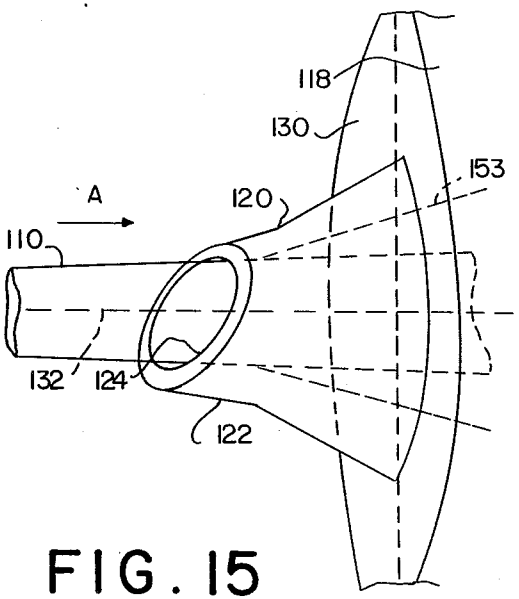
FIG. 15 is a fragmentary perspective view, to a different scale, of the nozzle tip of FIG. 13 showing the cooperation of a needle therewith.

Referring to FIGS. 13 to 15 of the drawings, there is shown a nozzle 112 for use in a gas-operated spraying apparatus (such as that shown in FIG. 3). The nozzle is preferably moulded from a plastics material as described in the aforesaid patent application. The nozzle has a body 146 which provides air passages 173 longitudinally of the surface of the body. The nozzle has, at one end, a tip 115. The tip 115 includes a first conically tapered region 116, a substantially cylindrical region 118 of zero taper which as a centering projection relative to an air cap (not shown), a further conically tapered region 120 and an outlet region 122 of a different conical taper. An outlet aperture 124 in the region 122 permits a medium such as paint to flow through a passage 153 (indicated in FIG. 15) axially disposed of the body 146 of the nozzle 112. A needle 110 (see FIG. 15) of circular cross-section is located, in use, axially of the nozzle body 146 and projects through the outlet aperture 124 forming a seal therewith in a rest position of the needle. The needle 110 has a lesser taper than that of the portion of the axial passage 153 defining the outlet aperture 124.

The needle 110 is retractable from its rest position, in which it forms a seal, in the direction fo the arrow A to permit the medium such as paint to be ducted through the outlet aperture 124 to be sprayed.

It will be seen that the further conically tapered region 120 is a truncated right circular cone relative to an end face 130 of the cylindrical region 118 of the tip and is coaxial with an axis 132 of the passage 153 itself coaxial with the body 146 of the nozzle 112. The outlet region 122 also comprises a right circular cone (see FIGS. 14*a*, 14*b* and 15) coaxial with the axis 132. However, the region 122 is truncated obliquely relative to the axis 132 to form the outlet aperture 124. The aperture 124 is thus planar but elliptical in shape.

If the region 122 had been truncated orthogonally of the axis 132, as the needle 110 was retracted in use, an annulus would be formed providing, theoretically, an equal flow of medium such as paint over the surface of the needle. In practice, if the needle is permitted to float within the aperture (as described above), it tends to lie at one side of the aperture 124 forming a crescent shaped outlet for paint.

It has been found that, if the aperture 124 is non-circular e.g. elliptical as described, the paint flow can be reduced even further, for a given area of the aperture 124, so that even finer lines may be "drawn". It is not certain how the ability to draw even finer lines, than those possible with a nozzle as described above, is achieved. It may be due to the double crecent annulus formed as the needle 110 is retracted (if the needle floats axially of the nozzle) or it may be due to a single crescent of the same area but greater width. In any case, there is a much reduced tendency to uneven spray e.g. blobs of paint, and, hence, an increased control in the drawing of extremely fine lines.

Further, it has been found that there is an optimum position of the nozzle 112 relative to a surrounding air cap for controlling the spray for drawing fine lines.

As mentioned above, the needle 110 effectively floats in the aperture 124. Gravity may cause it to take a lower than axial position. However, other forces on the needle tend to exceed those due to gravity. It is not certain what position is taken up by the needle 110 in the aperture 124 during use. Suffice it to say that, if the nozzle 112 is rotated about its axis, relative to a surrounding air cap, an optimum position of the nozzle can be found for the finest lines. To this end, the nozzle 112 may be provided with indexing means enabling its position, in use, to be selected. The indexing means may be provided by obturations 134 (see FIG. 13) which obturations locate the nozzle in a spraying apparatus and locate an air cap (not shown but which has matching recesses) thereon and, due to their circumferential symmetry permit say five selectable angular positions of the nozzle 112 relative to an air cap.

Conventionally, a nozzle is matched to its air cap. However, a nozzle according to the invention may be one of a series of nozzles having different sized outlets for use with a common air cap. This is possible because of the uniformity of moulded nozzles, the preferred method of fabricating nozzles according to the present invention.

This embodiment of the invention is not confined to the precise details of the foregoing example and variations may be made thereto. For instance, the truncation of the outlet region 122 may not be planar but may be stepped or curved. The nozzle may have a single taper conical tip 115 or may be of a more complex shape having a plurality of tapers.

The nozzle body 146 may be of any appropriate form for interfitting with an air cap and a spraying apparatus. Such spraying apparatus and air cap may be as described above.

Another feature which may be utilised in an airbrush according to the invention is shown diagrammatically in FIG. 16. As mentioned above, greatest control is required by an operator when least paint is being dispensed. It is preferred that any movement of the needle, initially should be caused by a magnified movement of operating member 24 i.e. movement of the needle should be some reduced function of movement of the operating member 24. For example, arcuate movement of the operating member 24 may cause movement of the needle 12 in dependance, at least initially, upon the square of the arcuate movement.

As shown in FIG. 16, the operating member 24 comprises a control lever 74 suspended by pivotal links 75, 76 in a slot 77 in the body 22 of the airbrush. The needle operating plunger 60 is slidably located in the body 22 and is urged by a spring 78, acting on a lever 79 pivotally connected to the plunger 60, to the left as seen in FIG. 16 to bias the needle to its sealing position in the nozzle.

The lever 79 also pivotally connects to the suspension link 75 which, in turn, pivotally connects an edge of a plate 80 supporting the control lever 74. At an opposite edge of the plate 80, the link 76 pivotally connects the plate 80 with an adjustable stop 81 formed by a non-rotatable captive nut 84 in the body 22 of the airbrush. The stop 81 defines the rest (sealing) position of the needle 10. The control lever 74 can be depressed (see FIG. 2) to operate an air valve (see FIG. 17).

Such movement has little effect on the dispensation of paint as the movement of the needle ocassioned thereby is insufficient to open the annular passage between the needle tip 11 and the nozzle 12. However, if desired, effective use of this movement of the needle can be made if the rest position of the needle is preset using the captive nut 84, to provide a predetermined dispensation of paint merely upon depression of the control lever 74. On the other hand, some lost motion may be provided to prevent rearward movement of the plunger 60, and hence of the needle upon depression of the lever 74.

If the control lever 74 is moved rearwardly, its suspension ensures that a reduced motion is transferred via the linkage to the plunger 60 to move the latter to the right, as seen in the drawings, and thereby permit corresponding movement of the needle 10 under the action of its spring.

It will be appreciated that the links 75, 76 operate only in tension and could therefore be replaced by cords, wires or the like.

In accordance with a desirable further feature of an airbrush as described herein, control of the air supply to the nozzle can be enhanced.

Figure 17:
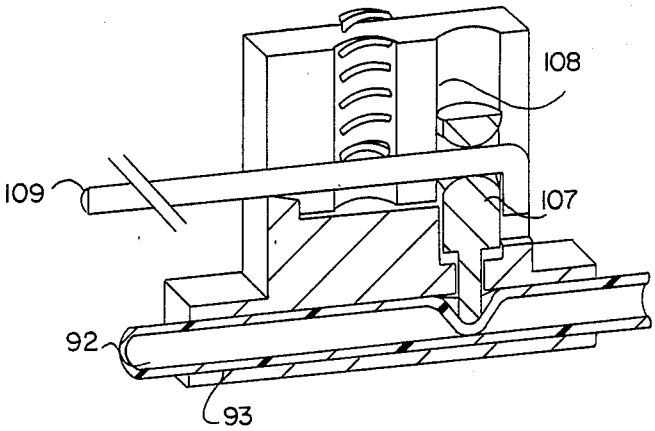
FIG. 17 is a diagrammatic sketch of a direct manual control means for controlling airflow.

Referring to FIG. 17, a very simple air control valve is shown in which air is ducted along a flexible tube 92 constrained by a duct 93 in the body of the airbrush and connectable to an air supply (not shown). The tube 92 is nipped by a valve member 107 vertically slidable in a slot 108 in the body. The position of the valve member is controlled by a pivotal lever 109 spring biased to urge the valve member to nip the tube 92. Depression of that end of the lever remote from the valve member against the spring bias, moves the valve member upwardly to free the tube and permit the flow of air to the airbrush nozzle. Such depression is effected, for example, by the element 80 of the linkage by corresponding movement of a control lever 74 similar to the control lever described in relation to FIG. 16.

Throughout this description, the terms "air" and "paint" have been used. It will be appreciated that any relatively inert gas, such as Freon (TM) or other (more environmentally accpetable) propellant may be used, instead of air. Similarly, the term "paint" has been used merely for the sake of simplicity as it is also known to spray both aqueous and non-aqueous based dyes or pigments and other non-coloured materials.

The invention may be applied to existing airbrushes or other micro-spraying or spraying equipment or to novel airbrushes, for example, as shown in FIG. 3. For example, it will be appreciated from FIGS. 5*a* to 5*h* and FIGS. 13 to 15, that many variations are possible of the cooperating surfaces of the nozzle and the aircap to vary the flow of air over the end of the nozzle and the protruding end of the needle to smooth or render turbulent or otherwise vary the airflow. Different effects are thereby obtainable and the illustrations only exemplify some of the combinations that have been tried. Further experimentation only is necessary to provide a wide variety of effects. It will similarly be appreciated that variations are possible of other integers described herein, and the description and drawings hereof are not to be considered in any way limitative thereof. Thus, variations are possible within the spirit of the present invention, the scope of which is defined in the appended claims.

I claim:

1. A nozzle, for a gas-operated spraying apparatus, said nozzle having an axial passage for paint to be dispensed;

a first end of said nozzle an outlet communicating with said axial passage;

a needle located in said passage, said needle having a tapered end projecting through said outlet;

said needle having a first end position wherein said tapered end forms a seal for said outlet;

said needle being arranged for movement from said first end position in a first direction axially of said passage progressively towards a second position;

said needle, in said progressive movement towards said second position, being arranged to unseal said outlet and to define an opening peripherally of said tapered end of said needle;

said needle, at least initially in said progressive movement, extending through said outlet to dispense paint;

said needle being arranged for movement in a second direction, opposite said first direction, from said first end position, to confirm said seal;

said nozzle being formed of a material having a resilient memory and said tapered end of said needle, on movement of said needle beyond said first end position in said second opposite direction, being arranged to expand said outlet of said nozzle but, on movement again of said needle in said first direction towards said second position, permitting said outlet of said nozzle to contract around said tapered end of said needle, under the influence of said resilient memory, to its original shape.

2. A nozzle according to claim 1 wherein said tapered end of said needle has a taper which increases towards the tip and wherein said axial passage tapers internally to said outlet, the taper of said axial passage being greater than said taper of said tapered end of said needle.

3. A nozzle according to claim 1 wherein said passage extends axially of said nozzle between said first end and a second end thereof, said needle extending axially therethrough, said end of said needle opposite said tapered end having stop means preventing passage of said needle through said nozzle in said second opposite direction.

4. A nozzle according to claim 1 further including spring means in said nozzle for urging said needle in said first direction from said sealing position.

5. A gas-operated spraying apparatus incorporating a nozzle according to claim 1, said apparatus having internal surfaces defining a gas and paint outlet, said needle and said nozzle being of substantially commensurate length and being assemblable together as a unit for coaxial insertion into and removal from said gas and paint outlet of said spraying apparatus.

6. A spraying apparatus according to claim 5 having separate paint and gas passages opening into said outlet, said nozzle having an external surface, said external surface providing integral seals for sealing between said paint and gas passages in said spraying apparatus, and said integral seals including means cooperating with said internal surfaces of said spraying apparatus, for obviating pressure difference between said gas passage and said paint passage for preventing gas leaking into the paint.

7. A spraying apparatus according to claim 6 wherein at least a part of said external surface of said nozzle is of non-circular shape, said internal surfaces of said gas and paint outlet having a correspondingly shaped part, said non-circular shaped part of said nozzle and said correspondingly shaped part of said internal surfaces cooperating to prevent rotation of said nozzle on insertion thereof into said spraying apparatus.

8. A spraying apparatus according to claim 6 wherein said needle has an axis and an end remote from said tapered end, said needle also having means for centering said needle within said nozzle, said centering means bneing arranged to act on said end remote from said tapered end of said needle so as to exert minimum force upon said needle, transverse to its axis, in said nozzle outlet.

9. A spraying apparatus according to claim 5 having a manually retractable plunger, said plunger having first spring means and being urged thereby towards a rest position in engagement with said needle, said engagement of said plunger with said needle urging said needle in said second direction into sealing engagement with said outlet of said nozzle, there being second spring means in said nozzle for urging said needle in said first direction from its sealing position whereby, upon manual retraction of said plunger, said needle retracts in said first direction, in said nozzle, under the action of said second spring means.

10. A nozzle according to claim 1, said nozzle being tapered at said first end, said needle having a circular cross-section and extending substantially coaxially of said axial passage and of said nozzle, and in which said outlet is of non-circular form.

11. A nozzle according to claim 10 wherein said needle is of substantially the same length as the nozzle, wherein said first end of the nozzle is of conical shape coaxial with said axial passage through the nozzle, and wherein said tapered first end has a plurality of tapered regions.

12. A nozzle according to claim 10 wherein said outlet is planar and is constituted by a truncation of said tapered first end of said nozzle in a plane not orthogonal to said axial passage.

13. A nozzle according to claim 10, said nozzle having a body, said body having means on said body for cooperation with an air cap of spraying apparatus permitting said nozzle to be indexed, in use, relative to the air cap.

14. A nozzle for insertion in a gas-operated spraying apparatus for spraying a medium such as paint, said nozzle being formed of a material having a resilient memory and comprising a body having an axial passage, a tip at one end of said body, said axial passage termianting in an oulet in said tip, a needle located in said passage, said needle having a first end tapering to a point, said needle having a first position in which said tapered first end of said needle cooperates with said outlet to seal the same; said needle being movable from said first position in a first direction axially of said passage to unseal said outlet and to define an opening peripherally of said tapered first end of said needle, said needle being arranged for movement in a second direction, opposite said first direction, to confirm said seal by expanding said outlet of said nozzle, said needle having a second, opposite end providing a head, said head cooperating, in use, with means in a spraying apparatus for permitting said movement of said needle in said first direction to unseal said outlet, said needle and said nozzle being of substantially commensurate length and being formed as a unit for insertion together into a spraying apparatus.

* * * * *